US009093762B2

(12) United States Patent
Schwarzkopf et al.

(10) Patent No.: US 9,093,762 B2
(45) Date of Patent: Jul. 28, 2015

(54) ELECTRICAL CONNECTOR HAVING CONDUCTOR MARKING MEANS

(75) Inventors: Michael Schwarzkopf, Detmold (DE); Stefan Aporius, Lage (DE); Andreas Wieneke, Lemgo (DE)

(73) Assignee: Weidmueller Interface GmbH & Co. KG, Detmold (DE)

( * ) Notice: Subject to any disclaimer, the term of this patent is extended or adjusted under 35 U.S.C. 154(b) by 59 days.

(21) Appl. No.: 13/983,966

(22) PCT Filed: Mar. 16, 2012

(86) PCT No.: PCT/EP2012/054647

§ 371 (c)(1),
(2), (4) Date: Sep. 30, 2013

(87) PCT Pub. No.: WO2012/130635

PCT Pub. Date: Oct. 4, 2012

(65) Prior Publication Data

US 2014/0017934 A1 Jan. 16, 2014

(30) Foreign Application Priority Data

Mar. 31, 2011 (DE) ..... 20 2011 000 748 U

(51) Int. Cl.
*H01R 4/48* (2006.01)
*H01R 9/24* (2006.01)

(52) U.S. Cl.
CPC ..... *H01R 4/48* (2013.01); *H01R 4/4836* (2013.01); *H01R 9/2475* (2013.01)

(58) Field of Classification Search
CPC ..... H01R 4/48; H01R 9/2475
USPC ..... 116/279; 439/491
See application file for complete search history.

(56) References Cited

U.S. PATENT DOCUMENTS

| | | | | |
|---|---|---|---|---|
| 6,146,217 | A * | 11/2000 | Osada | 439/835 |
| 6,796,855 | B2 * | 9/2004 | Fricke et al. | 439/835 |
| 8,475,191 | B2 * | 7/2013 | Schafmeister | 439/266 |
| 8,858,269 | B2 * | 10/2014 | Brand et al. | 439/733.1 |
| 2012/0289098 | A1 * | 11/2012 | Stjepanovic et al. | 439/822 |

FOREIGN PATENT DOCUMENTS

| | | | |
|---|---|---|---|
| DE | 967983 | | 12/1957 |
| DE | 58773 | A5 | 11/1967 |
| DE | 2416231 | A1 | 10/1975 |
| DE | 20014918 | U1 | 6/2001 |
| DE | 20205821 | U1 | 9/2003 |
| DE | 202010008028 | U1 | 2/2011 |

* cited by examiner

*Primary Examiner* — Amy Cohen Johnson
*Assistant Examiner* — Matthew T Dzierzynski
(74) *Attorney, Agent, or Firm* — Lawrence E. Laubscher, Sr.; Lawrence E. Laubscher, Jr.; Robert D. Spendlove

(57) ABSTRACT

A marking arrangement serves to identify the various conductors connected with the contacts of an electrical connector, including a plurality of indicia-bearing marking members that are respectively connected with the actuating elements that selectively unlock the resilient retaining devices that fasten the conductors to the connector body. The marking members include shaft portions that extend longitudinally into openings contained in one end of the longitudinally-displaceable actuating members, respectively. The other ends of the actuating members are in engagement with the retaining springs that normally bias the conductors into electrical engagement with conductor seats on contacts contained within the connector through ducts, respectively.

9 Claims, 1 Drawing Sheet

ELECTRICAL CONNECTOR HAVING CONDUCTOR MARKING MEANS

REFERENCE TO RELATED APPLICATIONS

This application is a national stage application under 35 U.S.C. §371 of PCT Application No. PCT/EP2012/054647 filed Mar. 16, 2012, which claims priority of German application No. 20 2011 000 748.0 filed Mar. 31, 2011

BACKGROUND OF THE INVENTION

1. Field of the Invention

A marking arrangement serves to identify the various conductors connected with the contacts of an electrical connector, including a plurality of indicia-bearing marking members that are respectively connected with the actuating elements that selectively unlock the resilient retaining devices that fasten the conductors to the connector body.

2. Description of Related Art

It is known in the patented prior art to provide widely varying models of electrical connecting devices. These connectors can be made in single-pole or multi-pole model. In preferred models, the electrical conductors are fixed without screws by means of at least one biasing retaining spring.

To designate or identify the electrical conductors, the provision of marking elements are advantageous or perhaps even necessary, provided they have a printable identification surface, or a surface that can be written upon in some other way. The arrangement of these elements on the connection devices or in the vicinity of the connection devices often causes a problem because the available space is very limited.

The present invention was developed to solve this problem.

SUMMARY OF THE INVENTION

Accordingly, a primary object of the present invention is to provide a marking arrangement that serves to identify the various conductors connected with the contacts of an electrical connector, including a plurality of indicia-bearing marking members that are respectively connected with the actuating elements that selectively unlock the resilient retaining devices that fasten the conductors to the connector body.

According to another object of the invention, the marking members include shaft portions that extend longitudinally into openings contained in one end of the longitudinally-displaceable actuating members, respectively. The other ends of the actuating members are in engagement with the retaining springs that normally bias the conductors into electrical engagement with conductor seats on contacts contained within the connector through ducts, respectively.

According to a further object of the invention, the marking devices are arranged in a particularly space-saving manner on the actuation elements of the connector.

The invention is particularly suitable for actuation elements of connecting devices in the push-in technique. Here it is particularly advantageous because precisely when the connecting devices are designed for conductors with a small cross-section, only a small amount of space is available for the attachment of markers or marking devices. In contrast, the actuation elements offer an existing advantageous spot for the attachment of the marking devices.

This is because the space on the actuation element is in this way almost used doubly: on the one hand, for the actuation function, and on the other hand, for the marking function. The operability of the push-in connection is not impeded in the process by the marking function.

As an alternative, marking devices could be arranged on the actuation elements of connection devices using a different connection technique, for example, especially on actuation devices for extension spring terminals or IDC terminals.

The connectors as such can again be employed on plug-in devices, terminal blocks, or other instruments of the most varied kind.

A particularly advantageous way of handling each plug-in element exists when the shaft, according to a preferred embodiment, is made cylindrical, whereby the basic diameter of the cylinder is less than the inside diameter of each plug-in duct and whereby the shaft of each plug-in element has at least one drastically deformable longitudinal locking rib which extends at least over the terminal section of the shaft. By the basic diameter is meant the diameter of the shaft upon which the locking ribs are molded. Alternate embodiments for the cylindrical shape are conceivable: for example, an oval or a polygonal cross-section, or in some other way.

During the insertion of each plug-in marking element, there occurs a deformation of the locking ribs so that, accordingly, a form-locking fixation takes place, which is to be seen like an undercut. Each locking rib extends along the longitudinal direction of the shaft.

Preferably, three circumferentially spaced locking ribs are provided on the shaft portion of the marking device. In this way, the locking ribs, so to speak, create a guide. To make sure that the plastic deformation and the formation of an undercut will be possible, it is provided that each plug-in duct has a free space on the side facing away from the head of the applied plug-in element.

An optional form-locking effect between the actuation element and the head on the mutually facing sides provides for security against twisting between the head and the actuation element. In a preferred embodiment, it is provided here that every head of the plug-in element on the side facing toward the actuation element have at least one integral transverse rib that rests against the outside surface of the actuation element in a corresponding recess contained in the face of the actuation element.

With a view to saving material and good ejection out of the mold tool, it is provided that the cross-section of the forming pin be made trapezoidal. Usually, the plug-in elements are made of synthetic substance by way of the injection-molding method using appropriate tools.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figure 1:
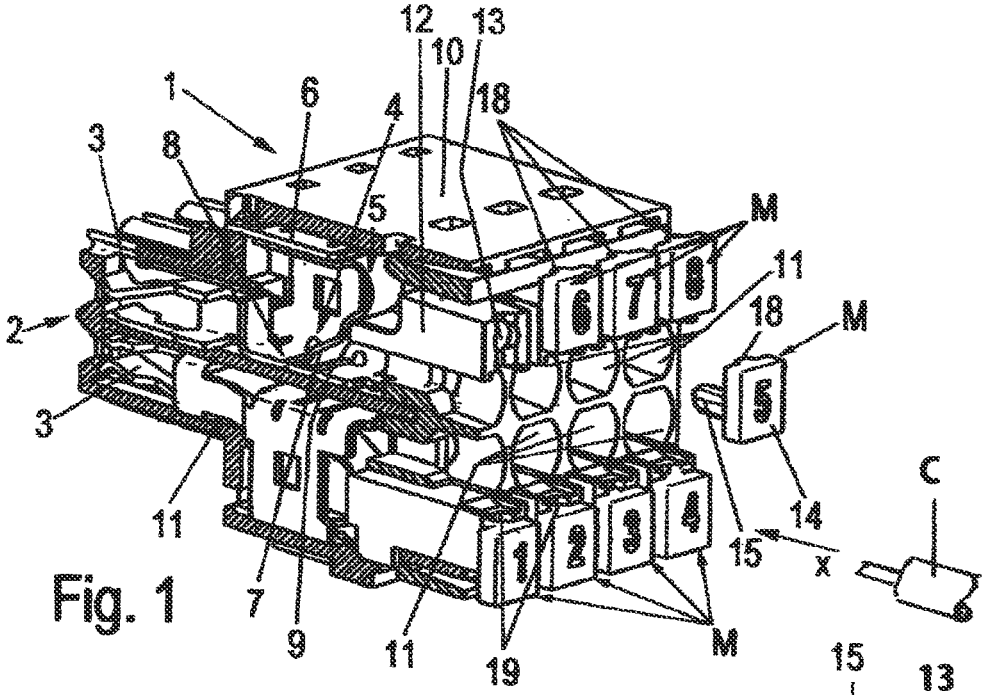
FIG. 1 is a perspective view of the multiple-contact electrical connector including the marking arrangement of the present invention.
Figure 2:
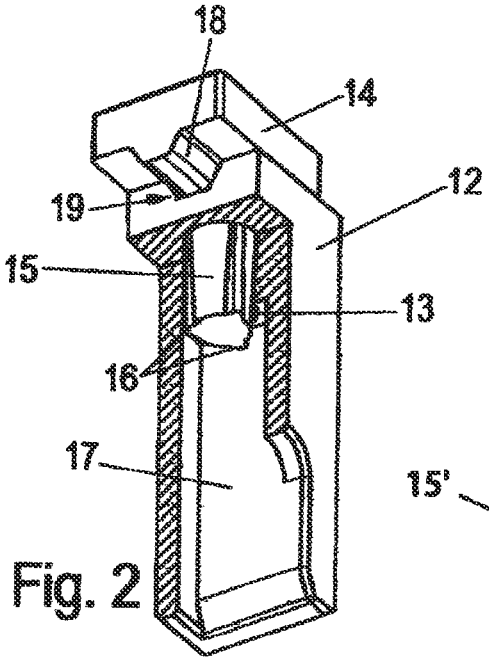
FIG. 2 is a perspective view of on the of actuator elements of FIG. 1 having a marking device mounted thereon.

Referring first more particularly to FIG. 1, the connector body 1 includes a front end 2 containing a plurality of openings defined by longitudinal conductor insertion through bores 11 in which are mounted a plurality of female electrical contacts 3, respectively. The contacts include integral cage portions 6 having conductor support seats 8 for supporting the bare ends of insulated conductors C, respectively, that are inserted into the other ends of the conductor insertion bores 11. Each conductor bare end is biased toward electrical engagement with the corresponding seat 8 by a leaf spring 5 connected with the contact cage portion 6.

The female contacts 3 are arranged in two adjacent rows shown by way of example here. The connector 1 and its female contacts 3 are made for contacting a corresponding pin strip, not illustrated here, with pin contacts or for the contacting of pin contacts upon a printed circuit board.

On the side facing away from the plug-in front, each pin contact 3 is connected in a conducting manner with a connecting device 4 for a conductor. These connecting devices 4 for conductors are made here as push-in terminals. Push-in terminals are known, for example, from the German Gebrauchsmuster No. DE 20 2010 008 028 U1.

Friction spring 5 is a leaf spring having a friction leg 7, which is designed to press a conductor in the area of a friction seat 8 against an inside wall 9 of the friction cage or against a bus bar.

The connecting devices 4 and the female contacts 3 connected with them in a conducting manner are inserted in a housing 10. This housing 10 is provided with a plurality of conductor insertion ducts 11 that are here arranged next to each other and on top of each other into which the conductors C can be inserted adjacent the conductor seats 8, respectively.

Associated with each connecting device 4 is a longitudinally displaceable actuation element 12, having a first end operable for insertion into the associated cage portion 6 to push the friction leg 7 in the conductor insertion direction X in order to open the friction point of the gate, thereby to permit the removal of a conductor from, or the introduction of a conductor into, a given longitudinal conductor insertion bore 11. The actuation element has a second end external of the conductor body that contains a marking member insertion duct 13 that extends into or parallel with the conductor insertion duct, and that is made as a passage opening that runs through the actuation element in the conductor insertion direction X.

Associated with each one or here specifically in a preferred embodiment associated with each connecting device 4, there is furthermore a marking device M, which is also made as an insertion element. The precise shape of the plug-in elements can be seen in FIG. 1 in conjunction with FIG. 3. Accordingly, each plug-in element consists of a head portion 14 and a shaft portion 15. Shaft portion 15 here is cylindrical, while head portion 14 in this exemplary embodiment has a quadratic configuration. Alternatively, the shaft portion 15' could have an oval cross-section, as shown in FIG. 4.

Figure 3:
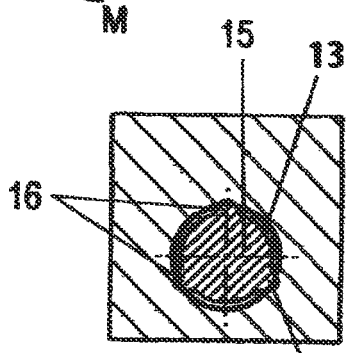
FIG. 3 is a cross-sectional view of the shaft and actuator element of FIG. 2.
Figure 4:
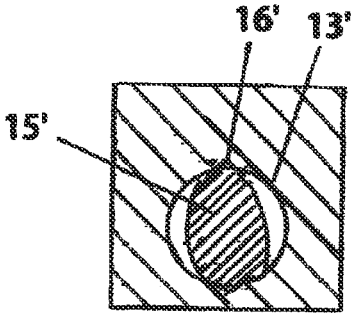
FIG. 4 is a cross-sectional view of an alternate marking member shaft embodiment.

As seen particularly in FIG. 3, shaft 15 of marking element M is provided with, in this case, three safety ribs 16 extending in the longitudinal direction, whereby the basic diameter of shaft 15 is less than the diameter of the marking member insertion duct 13. In this way, each marking element M can be inserted with a certain expenditure of force into the associated marking member insertion duct 13. In the process, the form-elastic and material-elastic properties of synthetic substances are utilized so that there will be a force-fit deformation of each marking element M. For this purpose, a free space 17 is then provided in connection upon each marking member insertion duct 13.

FIG. 1 shows that each marking element M or the head 14 of each marking element M on the side facing toward housing 10 has at least one integral rib 18, which preferably has a trapezoidal cross-section here. These integral ribs 18 in the assembled state engage in correspondingly shaped recesses 19 on the surface of the actuation element 12 that faces toward head 14. As a result, during assembly, there will be an alignment as well as a centering, and with simple means, there will be an additional position and turning safety between head 14 and the actuation element. It is also conceivable for the purpose of taking out each marking element M to insert a tool into this area. Preferably, the surface of head 14 in a plane normal to the conductor insertion direction X is greater than the surface of the corresponding side of the actuation element 12 so that, on the one hand, a large surface will be available for indicia and, on the other hand, removal will be made easier.

It is advantageous that the shaft portion 15 of each marking element M is provided with ribs 16 extending in the longitudinal direction and that below each marking shaft duct 13 there is a free space 17 so that a deformation-locking fixation of each plug-in element M is possible, which will act like an undercut. Furthermore, it is advantageous that each head 14 of plug-in element M is provided with integral transverse ribs 18 so that alignment and extraction of the marking member will be possible.

While in accordance with the provisions of the Patent Statutes the preferred forms and embodiments of the invention have been illustrated and described, it will be apparent to those skilled in the art that changes may be made without deviating from the invention described above.

What is claimed is:

1. An electrical connector including a conductor marking arrangement, comprising:

(a) a connector body (1) containing a plurality of longitudinal conductor through bores (11) having first ends for receiving the bare ends of a plurality of insulated electrical conductors (C), respectively, said conductor bores having second ends, respectively;

(b) a plurality of electrical contacts (3) mounted in said conductor bore second ends for electrical engagement with said conductor bare ends when said conductors are introduced toward fully engaged positions within said conductor bores, respectively;

(c) a plurality resilient retaining springs (5) normally having locked conditions for frictionally retaining said conductors in said fully engaged positions in said conductor bores, respectively:

(d) a plurality of actuating elements (12) connected for longitudinal sliding displacement relative to said connector body between retracted and inserted positions relative to said connector body, said actuating elements having first ends associated with corresponding retaining springs, respectively, such that each retaining spring is displaced toward an unlocked condition when the corresponding actuating element is inserted toward its inserted position, said actuating elements having second ends arranged externally relative to said connector body, said actuating element second ends containing longitudinal marking member insertion ducts (13), respectively; and (e) a plurality of distinctive indicia bearing marking devices (M) connected with said actuating element second ends, respectively, said marking devices include integral shaft portions (15) that extend into said marking member insertion ducts, respectively, thereby to identify the conductors associated with said contacts, respectively.

2. An electrical connector as defined in claim 1, wherein each of said contacts includes a support seat (8), said retaining springs biasing the conductor bare ends into electrical engagement with corresponding ones of said support seats, respectively.

3. An electrical connector as defined in claim 1, wherein each of said marking devices includes an integral enlarged head portion (18) that abuts the second end of the associated actuating element.

4. An electrical connector as defined in claim 1, wherein said retaining spring comprises a leaf spring.

5. An electrical connector as defined in claim 3, wherein marking device shaft portions (15) are generally cylindrical.

6. An electrical connector as defined in claim 3, wherein marking device shaft portions (15') have a generally oval cross-sectional configuration.

7. An electrical connector as defined in claim 3, wherein each of said marking device shaft portions has an outer peripheral surface including a plurality of longitudinally-extending circumferentially-spaced safety ribs (16; 16') in engagement with the inner surface of the associated mounting opening.

8. An electrical connector as defined in claim 7, wherein said safety ribs are deformed by a force fit into engagement with the adjacent wall surface of the associated mounting opening.

9. An electrical connector as defined in claim 8, wherein said marking device head portion includes a transverse rib (18) that extends within a corresponding groove (19) contained in the adjacent surface of the actuating element second end.

* * * * *